US006315059B1

(12) United States Patent
Geldean

(10) Patent No.: US 6,315,059 B1
(45) Date of Patent: Nov. 13, 2001

(54) PORTABLE WATER WELL DRILL

(75) Inventor: Allan Geldean, Miami, FL (US)

(73) Assignee: Dorothy Geldean, Miami, FL (US)

( * ) Notice: Subject to any disclaimer, the term of this patent is extended or adjusted under 35 U.S.C. 154(b) by 0 days.

(21) Appl. No.: 09/506,860

(22) Filed: Dec. 21, 1999

(51) Int. Cl.[7] ..... B25D 17/00; E21C 5/06

(52) U.S. Cl. ..... 173/31; 173/112; 173/147

(58) Field of Search ..... 173/31, 32, 147, 173/184, 185, 28, 195, 112, 21; 175/122, 162

(56) References Cited

U.S. PATENT DOCUMENTS

| | | | | |
|---|---|---|---|---|
| 1,174,163 | * | 3/1916 | Johnston | 173/147 |
| 1,966,008 | * | 7/1934 | Forney | 173/147 |
| 2,179,316 | * | 11/1939 | Anderson | 173/147 |
| 3,268,015 | * | 8/1966 | Stevenson | 173/147 |
| 3,316,983 | * | 5/1967 | Goodman | 173/147 |
| 3,570,606 | * | 3/1971 | Guritz | 173/186 |
| 3,830,315 | * | 8/1974 | Love | 173/147 |
| 3,854,537 | * | 12/1974 | Nelmark et al. | 173/147 |
| 4,020,909 | * | 5/1977 | Airaudo | 173/147 |
| 4,250,973 | * | 2/1981 | Hall | 173/147 |
| 4,434,860 | * | 3/1984 | Deyo | 173/147 |
| 5,199,507 | * | 4/1993 | Westmoreland | 173/147 |
| 5,343,962 | * | 9/1994 | Daigle et al. | 173/147 |
| 5,667,021 | * | 9/1997 | Bailey et al. | 173/147 |

* cited by examiner

*Primary Examiner*—Scott A. Smith
(74) *Attorney, Agent, or Firm*—Malin, Haley & DiMaggio, P.A.

(57) ABSTRACT

The present invention is a portable drilling rig having a support tower. A drilling engine, mounted within a cradle, and a lift winch are attached to the support tower. A stabilizer bar is attached to the lower end of the support tower to prevent swaying of the support tower. The engine transfers torque to the transmission mounted below the engine, to which a steel swivel, housing a quill, allows passage of air and/or water to a drill steel to provide rotary force to power a drill bit. A pull-down system, preferably a weighted bar, is attached to the lower end of the support tower and to the drilling engine to pull the drilling ending downwardly. Manual transport is provided by means of a main base wheel dolly system for easy one-man mobilization. A counter-weight is attached to the lower end of the support tower to prevent the support tower from being lifted as the pull-down system forces the drilling bit into the ground. Deflectors attached to the support tower prevent debris coming out of the hole from splashing on the present invention and the operators. A gas/water control manifold attached to the collar of the drilling engine functions to mix water and gas which is forced through the center of the drilling rod to cool the drilling bit and remove drilling debris from the hole.

14 Claims, 2 Drawing Sheets

PORTABLE WATER WELL DRILL

BACKGROUND OF THE INVENTION

1. Field of the Invention

The present invention relates to well drilling. More particularly, the present invention relates to water well drilling in confined spaces. The present invention relates generally to equipment useful in drilling water wells and/or earth bore holes. More specifically, this invention concerns a lightweight, portable drilling rig, capable of drilling shallow water wells in locations that are of a confined nature and/or considered to be impossible by larger drilling equipment. The present invention may be easily and quickly disassembled (if further necessary) and manually transported to areas not previously accessible to conventional drilling equipment currently available. The machine is capable of drilling a well in confined locations that would not be accessible by prior well rigs. It is now possible to effectively accomplish this in an acceptable time frame thereby allowing for a brand new market, which until now had been excluded.

2. Description of Related Art

Well drilling is well known in the art. The prior art inventions address the problem of drilling a hole in the ground through various materials. The well drilling equipment is generally configured for use on a vehicle and for large sized wells. Little attention has been paid to drilling wells in confined and unreachable locations. What is needed is a man portable well drilling device that can negotiate obstacles and barriers such as fences and narrow passageways.

In many areas of the country and throughout the world, it remains extremely difficult, if not impossible (i.e., location), to transport to a location drilling equipment necessary to drill water wells. Inadequate or nonexistent roads prevent conventional, heavy truck mounted water well drilling equipment from reaching the desired location. Because the substantial roads required to sustain such conventional drill rigs and truck mounted equipment are not available in many areas in underdeveloped and third world countries, large areas throughout the world are effectively isolated and it is not feasible to drill water wells in these locations.

A small, lightweight, easily portable yet effective drilling system is needed that would allow water wells to be drilled in currently isolated areas. A unit that is relatively simple to operate and which would not require highly skilled laborers is needed. If required, the present invention can be placed by helicopter in inaccessible areas along with the encompassing well drilling tools. The present invention addresses this critical need.

The present invention includes a drilling rig unit which can be manually mobilized to be transported to drill water wells and bore holes in even the most remote areas on earth. Further, the unit can be easily disassembled. The described drilling system includes a detachable mast, engine, engine cradle, winch assembly, transmission, air/water/mud injection flow control valve unit, main base stabilizers, and mobile wheel unit which is easily disassembled to aid in transport and to allow for crating to ship overseas. The winch assembly is attached to the rear mast pole and the top of the engine cradle through a cable to raise the engine assembly up the mast guided by a left and right mast pole engine cradle sliders. The winch assembly includes a modified hand winch which accommodates the mechanical cable pull-down system to provide pull-down pressure capabilities. Rotating the winch clockwise provides a hoisting action. By reversing the direction, the winch provides pull-down pressure via cables routed from the winch to the bottom of the base routed through pulleys and connected to springs mounted on each side of the engine cradle. Rotating direction of winch pulls cables to stretch tension on springs forcing downward pressure. To aid in downward pressure, a weight bar is mounted atop the engine cradle. At left and right distal ends weights can be added to the weight bar for additional pull-down enhancement and adjusted accordingly to rock formation requirements and drilling time. Winch design allows constant pressure to be applied to the springs.

The hand winch has two gear ratios for varying pull-down or hoisting loads or applications. This winch shares a common spool but has separate cables for pull-down and hoisting duties. The engine cradle allows the power unit and transmission to be removed from over the water well or bore hole to allow ease in installing well casings and or well pipe. This feature also allows aid in transporting or shipping the drill unit. The air/water/mud flow control valve is located below the transmission on the steel swivel unit. This allows quick diversion and adjusted control of drilling fluid or air and/or combination from the water well or bore hole, to a mud pit or vice versa. Important location of this flow control valve also allows hoses to travel freely and out of the way of the drilling operations and moving parts.

The main base is equipped with water deflector shields to protect the operator and equipment from debris and water forced up out of the well or bore hole under high air pressure. The two water deflector shields consist of a primary stationary deflector shield mounted under the main base and a secondary removable deflector mounted on the bottom of the drill steel guide table.

Under the main base is positioned the main base stabilizer rails. This is the counterweight for the pull-down system and helps prevent the unit from lifting itself off the ground. Stabilizer rails double as a stable base to spread support for the weight above on the pull-down assist weight bar. This counterweight, bottom heavy, eliminates the need for guy wires or tie-down ropes, allowing access to confined areas that would not allow tie-down ropes or guy wire area. The stabilizer rails allow for somewhat of a platform to raise the drill unit off the ground for observation of the drilling fluids or drill cuttings escape area and allows operators a platform to work upon out of mud or water.

A steel quill provides means of connecting the power unit torque through the transmission to the drill pipe and allows air injection or drilling fluid injection from a compressor unit or a pump to enter the hollow drill pipe through a multiple side port. The quill is directly coupled to the transmission connected to a power output shaft from a power unit.

A steel swivel housing is rigidly mounted to the rotary power unit but has a sheer pin to break away to prevent engine or transmission damage. The swivel housing is completely removable from the quill. Compression seals are greased through grease fittings at the top and bottom seal.

The present invention satisfies an important need not met by currently available drilling equipment. A primary advantage of this invention is that it provides a simple rotary air/water drilling unit with pull-down pressure capabilities. The invention provides a drilling rig that is truly manually portable for mobilization into areas where other power drilling rigs could not be brought or taken except through helicopter transport. The short height of this unit allows it to be accessible in areas where conventional drilling units were too tall. Confined or enclosed locations necessary for well placements are now accessible. This may possibly by the smallest rotary air/water/mud injection drilling unit with pull-down pressure capabilities.

The present invention provides a drilling system with a durable mast and fully stabilized base unit and is simple in design and operation. It includes commonly available parts and bolt-on components that are easily replaceable in the field to eliminate rig downtime for repair of worn parts. Equipment overhead repair and operation expense are affordably low in comparison to convention well drilling rigs drilling the same diameter wells as the present invention. The unit described is so simple to operate and repair that a person with only limited drilling experience can safely and effectively operate the rig after a brief training period is completed for either residential personal use or for commercial drilling use and affordable for either application.

An additional advantage of the present invention is that, despite its compact design, minimal pull-down pressure can be applied to the drill steel during the water well or bore hold drilling, although this is sometimes not necessary because of sufficient down pressure from the weights on the weight bar mounted on the engine cradle.

Yet another advantage over current available drilling rigs is the ability to remove the power unit and/or transmission from over the well or bore hole without removing the mast or the rest of the rig from its placement, for ease in well operations with well casings or for emergency engine repair or replacement.

The described invention also includes a compact drill steel table that allows for the rapid threading and unthreading of drill steel, and guides the steel straight during the drilling process.

Another advantage provided is the steel swivel arrangement that allows the power unit output shaft to be connected through the transmission to the drill steel through a quill that is used to direct high pressure compressed air and/or the injection of water, drilling fluids or mud to the drill bit.

All of these components of the present invention results in a lightweight, simplified, inexpensive alternative drilling system that can drill wells to depths of up to 200 feet in areas not currently accessible to conventional water well drill equipment. The inventor of the present invention has performed a great deal of research in the development of a prototype and has thoroughly tested the machine with great success in the United States.

The present invention produced unexpected results, namely better growth of plants and vegetables in household gardening because the water is natural and lacks treatment chemicals.

A synergistic effect was produced utilizing the present invention due to the following facts and results from prototype experimentation; a reduction in drinking water consumption due to a new well being used to water lawn irrigation.

Accordingly, it is an object of the present invention to provide a rotary air/water drilling rig which is effectively and feasibly able to drill through various rock formations throughout the world.

More particularly, it is an object of the present invention to provide a means to which a water well drill is portable and operable by one man and constructed to negotiate narrow passageways, negotiate residential walk gates, overhead utilities, and confined spaces often found in residential well drilling.

Numerous innovations for water well drill have been provided in the prior art that are described as follows. Even though these innovations may be suitable for the specific individual purposes which they address, they differ from the present invention as hereinafter contrasted.

In U.S. Pat. No. 5,199,507, issued to Westmoreland, a manually portable drilling system is described for the purpose of drilling earth bore holes. The drilling system will accommodate a lightweight drill pipe for air or mud rotary drilling, auger, or with use of air hammer percussion tools. The drilling system includes a self-contained mast which is detachable from a support base table. The mast contains an internal traveling shuttle to which a power unit is attached. The shuttle is manually driven by a conventional two-speed, reversible hand winch modified to allow both hoisting and pull-down capabilities. A partially hollow, perforated quill is coupled to an output drive of the power unit and drill pipe. This drilling system may be set up or broken down in minutes and carried to areas inaccessible by conventional portable drilling machines.

The patented invention differs from the present invention because the patented invention is a manually portable drilling system having a lightweight drill pipe for air or mud rotary drilling, auger, or with use of air hammer percussion tools. The patented invention has the following: a self-contained mast which is detachable from a support base table; an internal traveling shuttle; a power unit is attached which is attached to the internal traveling shuttle; a conventional two-speed, reversible hand winch modified to allow both hoisting and pull-down capabilities; and a quill which is partially hollow and perforated is coupled to an output drive of the power unit and drill pipe.

The patented invention lacks at least two wheels attached to the lower end of the support tower functioning to provide mobility. The patented invention further lacks a counterweight which is attached to the lower end of the support tower functioning to prevent the support tower from being lifted as the pull-down system forces the drilling bit into the ground. The patented invention is secured to the ground by a series of guy wires. The present invention has a table water deflector attached to the support tower and around the drilling rod functioning to prevent debris coming out of the hole from splashing on the present invention and the operators. The patented invention has a water cooling provision but lacks an air injection means.

In U.S. Pat. No. 4,585,080, issued to Bender, a drilling apparatus for drilling holes in remote locations, there is provided drilling apparatus consisting of hand-transportable modules which include a base assembly, a derrick removably mounted on the base assembly and including an elongated tubular member, a carriage moved along the tubular member by a block and tackle, and a hydraulic cylinder. The carriage has a detachable support portion that support a drill assembly on one side of the derrick for drilling and an anchor assembly on the other side of the derrick for anchoring the base assembly to the earth's surface. A hydrostatic drive system selectively actuates the carriage, drill and anchor.

The patented invention differs from the present invention because the patented invention is a drilling apparatus consisting of a base assembly, a derrick removably mounted on the base assembly and including an elongated tubular member and a carriage moved along the tubular member by a block and tackle, and a hydraulic cylinder. The carriage has a detachable support portion that supports a drill assembly on one side of the derrick for drilling and an anchor assembly on the other side of the derrick for anchoring the base assembly to the earth's surface. A hydrostatic drive system selectively actuates the carriage, drill and anchor. The present invention is driven by an internal combustion engine. Further, the present invention has provisions for injecting both cooling water and air into the center of the drill pipe.

In U.S. Pat. No. 4,487,271, issued to Pomeroy, et al., a portable core drill is described, which is adapted for sampling dense mineral specimens or the like by urging a fluid cooled/lubricated tubular drill bit into a dense mineral mass from which a sample is to be extracted is comprised of a drive member for imparting a drilling-effective rotary motion to a tubular drill bit about a longitudinal drill axis and a spindle member for coupling the drill bit to the drive member, which spindle member includes a bit fastening member for receiving and retaining the drill bit concentrically in respect of the drill axis. The bit fastening member, in turn, is comprised of a bit-engaging collet member, received in a collet housing having tapered sidewalls and an end wall, and a rotatable compression member (i) for constricting the collet member about the outer sidewall of the drill bit at or near the proximal end thereof upon rotation and (ii) for engaging an element on the collet member and urging the collet member outwardly of the collet housing upon counter-rotation; whereby the drill bit may be operatively engaged with and disengaged from the bit fastening member by hand rotation and counter-rotation of the compression member, respectively.

The patented invention differs from the present invention because the patented invention is a portable core drill which is adapted for sampling dense mineral specimens or the like by urging a fluid cooled/lubricated tubular drill bit into a dense mineral mass. The patented invention lacks features included in the present invention.

In U.S. Pat. No. 4,476,940, issued to Reichert, et al., a lightweight portable drilling apparatus is described which is capable of being assembled and disassembled for lifting and moving by helicopter. The apparatus includes a center, vertically-oriented drilling tower equipped with a rotary drilling assembly, and having a base supported by a plurality of adjustable leveling legs. Also included is a first module pivotally coupled to one side of the tower base and supported by a flexible tether attached to the module and the drilling tower near the top thereof, and a second module pivotally coupled to the other side of the base of the tower and supported by a flexible tether also attached to the drilling tower near the top thereof and to the second module. Each module includes either a power source, such as a diesel engine, or auxiliary power equipment for supplying power to operate the drilling assembly.

The patented invention differs from the present invention because the patented invention is a lightweight portable drilling apparatus which is capable of being assembled and disassembled for lifting and moving by helicopter. The apparatus is more complex and costly than the present invention. The patented invention functions with hydrostatic drives for the lift, down pulling and drill pipe rotation.

In U.S. Pat. No. 4,441,564, issued to Castillo, a hole drilling machine is described which includes a geared stationary drill frame with a guide track to which support legs are attached at either end, a drive shaft made of hollow flexible tubing driven by a motor suspended from the guide track and an adjustable swivel axle to which the drill end is mounted. The drill end is a hollow tube with openings in an end to permit streams of water to wash loose soil out of the hole and assist in the drilling process and a helical knife edge attached thereto. An angled metal piece with exit holes to permit the flow of water is attached to the working end.

The patented invention differs from the present invention because the patented invention is a hole drilling machine which includes a geared stationary drill frame with a guide track to which support legs are attached at either end. A drive shaft made of hollow flexible tubing is driven by a motor suspended from the guide track. The patented invention is not adapted to drilling deep holes through rock. The patented invention lacks a cooling means and air injection.

In U.S. Pat. No. 4,347,692, issued to Culver, a portable drilling rig is described for mounting on a flatbed truck or other carrier vehicle, includes a turntable rotatably mounted on the truck bed; a slide pivotally mounted on the top of the turntable for rotation around a horizontal axis; a hydraulic cylinder interconnecting the turntable and slide for raising and lowering one end of the slide so that the slide can be tilted from a transport position to an operating position beside the truck; a carriage slidably mounted on the side, the position of the carrier on the slide being controlled by a winch, pulley and cable system; a derrick pivotally mounted on the carriage for rotation between the transport and operating positions; and a hydraulic cylinder interconnecting the carriage and the derrick for causing the derrick to move between the transport and operating positions.

The patented invention differs from the present invention because the patented invention is a portable drilling rig for mounting on a flatbed truck. The patented invention lacks features included in the present invention.

In U.S. Pat. No. 4,269,395, issued to Newman, et al., a new and improved portable hydraulic rig is described for performing workover, drilling or other operations on a well, usually a petroleum well, wherein the rig has a telescoping mast for telescoping to a reduced length for transportation, wherein the mast is cantilevered in use so that the traveling block moves vertically at one side of the mast, wherein the cable for the traveling block is reeved over the various sheaves including sheaves on a hydraulic power assembly with the dead end of the line being fastened at or in proximity to the rig floor for balanced loading on the legs of the mast and to enable slack in the cables to be taken up when telescoping the mast.

The patented invention differs from the present invention because the patented invention is a portable hydraulic rig, wherein the rig has a telescoping mast and mounted on a vehicle. The patented invention further has a mast which is cantilevered in use so that the traveling block moves vertically at one side of the mast. The patented invention is hydrostatically driven and includes hydrostatic devices for raising and lowering the mast. The patented invention lacks at least two wheels attached to the lower end of the support tower functioning to provide mobility. The patented invention further lacks a counterweight which is attached to the lower end of the support tower functioning to prevent the support tower from being lifted as the pull-down system forces the drilling bit into the ground. The patented invention is secured to the ground by a series of guy wires. The present invention has a table water deflector attached to the support tower and around the drilling rod functioning to prevent debris coming out of the hole from splashing on the present invention and the operators. The patented invention has a water cooling provision but lacks an air injection means.

In U.S. Pat. No. 4,103,745, issued to Varich, et al., a portable drilling machine is described which comprises a derrick having longitudinal racks guiding a vertical traverse mechanism carrying a traverse having a means designed for rotation of a drill pipe during the drilling operation. A sand pipe is positioned longitudinally in the derrick in alignment with the drilling axis. A pull-down unit is connected through a closed flexible transmission with the vertical traverse mechanism and the traverse to feed, during the working run thereof, the drill pipe to the bottom of the hole and, during the reverse run thereof, raise the drill pipe. A clamp is designed for gripping the drill pipe on completion of the working run of the vertical traverse mechanism and the traverse and is mounted at the base of the derrick. The means for rotation of the drill pipe is designed as a power-driven rotating chuck mounted in the traverse, said chuck grips the drill pipe during the drilling operation, and can during an idle run, when it is unclenched together with the vertical traverse mechanism, regrip the pipe while the drill pipe is held by a clamp. Such drilling machines can make vertical and angle holes to the full depth by using only one long drill pipe in a most efficient manner as to rotation rate thereof and load on the bit, which makes such a drilling machine a high-capacity design.

The patented invention differs from the present invention because the patented invention is a portable drilling machine which is securely attached to a special vehicle designed for carrying the drilling rig. The patented invention is very complex and costly. Further, the patented invention is not easily portable and will not fit into confined spaces.

In U.S. Pat. No. 4,020,909, issued to Airaudo, an earth drilling apparatus is described comprising an extensible mast constituted by a fixed lower ramp and an upper slide mounted with capability of longitudinal sliding on the fixed ramp. A rotation head for driving a drill string is movable on and guided over the length of the slide and the movements of extension and retraction of the slide are synchronized with ascending and descending displacements respectively of the rotation head. For this purpose, two double-acting jacks connect the lower portion of the fixed ramp to the upper portion of the movable slide and each of a first pair of chains is wound on one pulley mounted on the upper extremity of each of the posts of the movable slide and is fixed at one of its extremities to the rotation head and at the other of its extremities to a cross-brace rigidly connecting the upper extremity of the posts of the fixed ramp. Each of a second pair of chains is wound on a pulley mounted at the lower extremity of each of the posts of the movable slide and is fixed at one of its extremities to the rotation head and at the other of its extremities to the cross brace. The axes of said jacks and the axes of said pulleys are disposed in a common plane.

The patented invention differs from the present invention because the patented invention is an earth drilling apparatus designed to be mounted on a vehicle and erected into position by a hydraulic means. The patented invention lacks the portability and light weight of the present invention. The patented invention lacks the feature of use in a confined space.

Numerous innovations for water well drills have been provided in the prior art that are adapted to be used. Even though these innovations may be suitable for the specific individual purposes to which they are addressed, they would not be suitable for the purposes of the present invention as heretofore described.

SUMMARY OF THE INVENTION

The present invention is a lightweight, rotary air/water injection, manually transportable, highly portable drilling unit, including a mechanical pull-down system, which is capable of drilling water wells or bore holes, and negotiating confined areas. This invention is characterized by its lightweight, simplified construction and operation that allows the drilling unit to be easily maneuvered by one man, disassembled if necessary and transported to the desired water well location, quickly reassembled, and put into drilling operation.

In the basic embodiment of the drilling unit, an engine cradle is slidably mounted inside a drilling mast. Mounted in the engine cradle is the power unit engine, transferring torque to the transmission mounted below the engine, to which a steel swivel housing a quill allows passage of air and/or water injection to which drill steel provides rotary force to power a drill bit. A specially developed hand-operated winch assembly is used to provide hoisting and pull-down pressure capabilities as required during drilling operations. Manual transport is provided by means of a main base wheel dolly system for easy one-man mobilization.

The present invention is a portable drilling rig having a support tower. A drilling engine is attached to the support tower by a sliding means. A lift winch is attached to the support tower and the drilling engine functions to support the drilling engine and lift both the drilling engine and the drilling shafts from the hole. A stabilizer bar which is attached to the lower end of the support tower functions to prevent swaying of the support tower. A pull-down system attached to the lower end of the support tower and to the drilling engine functions to pull the drilling ending downwardly. The pull-down system may be a plurality of weights which are attached to the drilling engine. At least two wheels attached to the lower end of the support tower functioning to provide mobility. A counterweight which is attached to the lower end of the support tower prevents the support tower from being lifted as the pull-down system forces the drilling bit into the ground. A table water deflector attached to the support tower and around the drilling rod functions to prevent debris coming out of the hole from splashing on the present invention and the operators. A gas/water control manifold attached to the collar of the drilling engine functions to mix water and gas which is forced through the center of the drilling rod to cool the drilling bit and remove drilling debris from the hole.

The well drilling equipment of the prior art are unsuitable for operation in confined spaces.

The present invention solved a long-felt need for a portable well drilling apparatus that is lightweight and is usable.

The present invention produced unexpected results, namely better growth of plants and vegetables in household gardens because the water is natural and lacks treatment chemicals.

A synergistic effect was produced utilizing the present invention due to a reduction in drinking water consumption due to the new well being used to water yards.

Accordingly, it is an object of the present invention to provide a water well drill which effectively drills wells through various materials including rock.

More particularly, it is an object of the present invention to provide a water well drill which is portable by one man and constructed to negotiate narrow passageways and confined spaces found in residential well drilling.

One feature of the present invention is a base having a base stabilizer bar and a pair of base cart wheels. When the base is designed in accordance with the present invention, a left vertical pole, a right vertical pole, and a back vertical pole function to support a well drilling apparatus.

In accordance with another feature of the present invention, a top is attached to a left vertical pole, a right vertical pole, and a back vertical pole functioning to position the top in a parallel relationship.

Another feature of the present invention is that a guide functions to guide the lower position of a drill pipe.

Yet another feature of the present invention is that an engine slides on the left vertical pole and right vertical pole.

Still another feature of the present invention is that the engine has an engine weight and an engine weight bar which function to provide a variable downward force on the drill bit.

Yet still another feature of the present invention is that the engine is attached to the left vertical pole and right vertical pole by an engine left guide and an engine right guide.

Still yet another feature of the present invention is that the engine has a transmission which is connected to a power ratchet which turns the drilling pipe.

Another feature of the present invention is that the power ratchet is connected to a swivel, permitting a swivel head to rotate therearound.

Yet another feature of the present invention is that the swivel head has an inlet which provides water and air to the center of the drill pipe.

Yet still another feature of the present invention is that a winch and winch cable are provided to lift the motor and rill pipe during operation.

The novel features which are considered characteristic for the invention are set forth in the appended claims. The invention itself, however, both as to its construction and its method of operation, together with additional objects and advantages thereof, will be best understood from the following description of the specific embodiments when read and understood in connection with the accompanying drawings.

In accordance with these and other objects which will become apparent hereinafter, the instant invention will now be described with particular reference to the accompanying drawings.

LIST OF REFERENCE NUMERALS UTILIZED IN THE DRAWINGS

1—Main Base
2—Left Mast Pole
3—Right Mast Pole
4—Rear Mast Pole
5—Engine
6—Engine Cradle
7—Transmission Drive Box
8—Transmission Output Drive Sheer Pin
9—Steel Swivel
10—Drill Steel Coupling
11—Drill Steel
12—Injection Inlet Tube
13—Water Flow Check Valve
14—Air Flow Control Valve
15—Left Pulldown Cable Spring Mount
16—Left Mount Bushing
17—Right Pulldown Cable Spring Mount
18—Right Mount Bushing
19—Left Pulldown Spring
20—Right Pulldown Spring
21—Left Cable Turnbuckle
22—Right Cable Turnbuckle
23—Left Pulldown Cable
24—Right Pulldown Cable
25—Left Base Cable Pulley
26—Right Base Cable Pulley
27—Left Cable Slack Adjuster
28—Right Cable Slack Adjuster
29—Left Rear Cable Guide Pulley
30—Right Rear Cable Guide Pulley
31—Lower Cable Guide Eye Bolt
32—Upper Cable Guide Eye Bolt
33—Spool
34—Spool Divider Plate
35—Pulldown Cable Spool Side
36—0 Hoist Cable Spool Side
37—Crank Handle
38—Hoist Cable
39—Throttle
40—Engine Stop Switch
41—Throttle Cable
42—Left Side of Weight Bar
43—Right Side of Weight Bar
44—Left Side Weights
45—Right Side Weights
46—Weight Lock
47—Drill Bit
48—Tee-Top
49—Top Cable Pulleys
A—Drill Steel Opening
A2—Primary Deflector Shield
ARR—Main Base Stabilizer Rails
R1—Front Rail
R2—Center Rail
R3—Rear Rail
B1—Secondary Deflector Shield
B9—Right Wheel
B8—Left Wheel
A8—Injection Flow Control Valve System Regulator Unit
A6—Weight Bar Pull Down Assist
A5—Mechanical Pulldown Pressure System

DESCRIPTION OF THE PREFERRED EMBODIMENT

Figure 1:
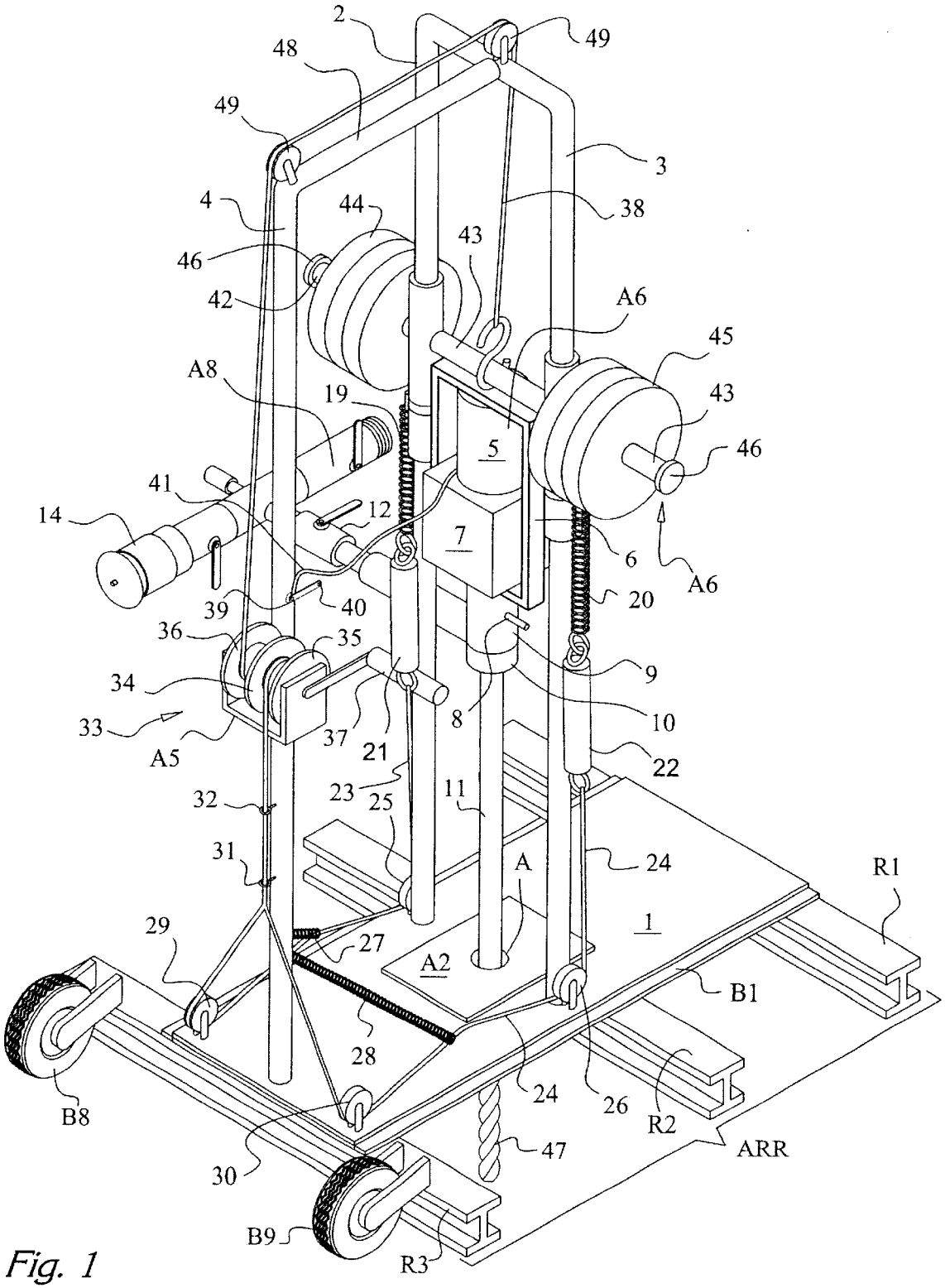
FIG. 1 is a perspective view of the water well drill of the present invention.

The present invention is a highly portable, manually transportable, rotary air/water/mud injection drilling unit with mechanical pull-down pressure system. The drilling unit is designed to be useful in the drilling of water wells and bore holes located in confined areas and capable of drilling well bores up to 200 feet in depth in areas not possible or feasible by previous drilling equipment. The drill rig can be easily further disassembled if the need arises by using small hand tools into pieces which can be carried by one or two men which would also aid in overseas crating and shipping. The drilling system does not require disassembly for mobilization as it is equipped with a mobile wheel system for manual mobilization.

The drilling system can be easily maneuvered into drilling position where a water well or bore hole is desired and quickly reassembled if required with the same hand tools. The drilling invention can accommodate lightweight drill steel for use with air, water or mud drilling or a combination of injection methods.

The rotary power unit and transmission is attached to an engine cradle which is slidably mounted inside a self-contained, detachable mast. The engine cradle is mechanically lowered or attached to the mast.

Firstly, referring to the figure which is a perspective view of a water well or bore hole drilling unit operated by one individual. A water well drilling unit A9 comprises a main base stabilizer rails platform ARR which consists of a front stabilizer rail R1, a center stabilizer rail R2, and a rear stabilizer rail R3. The rails platform's wide stance and substantial weight serves as a broad heavy base so no lines or ropes for guy wires are necessary. The platform also serves as a counterweight for the mechanical pull-down pressure system A5. This arrangement of stabilizer rails provides an elevated platform level to allow easy access to the well or bore hole for removal of bore hole rock cuttings and observation of drilling fluid circulation.

On the rear of the stabilizer rail R3 the mobile unit wheel dolly system extends, comprising a left wheel B8 and right wheel B9, rotatably mounted at opposite distal ends thereof. A main base 1 is securely mounted on the top side of main base stabilizer rails platform ARR. Sandwiched between the two components is a main base water deflector shield A2. In the center, positioned accordingly, is a drill steel opening A in which the drill steel 11 passes through. The purpose of the main base water deflector shield is to serve as a primary shield to prevent the operator of the engine from dirt or water, mud or debris exiting the water well or bore hole forced from high pressure. The main base 1 is molded to accept the drill steel table water deflector shield B1, provided as a secondary water deflector shield. The purpose of the secondary deflector shield is to prevent water or rocks and debris from striking the operator and the engine thereby causing injury and/or engine failure.

Positioned on the left center of the main base 1 is a left mast pole 2, securely connected extending upwardly vertically therefrom. Opposite on the main base 1 is right mast pole 3, securely connected extending upwardly vertically therefrom. Positioned on the rear center is a rear mast pole 4, securely connected extending upwardly vertically therefrom. A tee top 48 is securely connected to top distal ends of left mast pole 2, right mast pole 3, and rear mast pole 4.

Mounted slidably on the left mast pole 2 and right mast pole 3 is an engine cradle 6, which securely connects the engine 5 and a rotary gear reduction transmission drive box 7. Inclusive is a transmission output drive sheer pin 8 connecting the steel swivel 9. This rotates, allowing power torque rotation to travel via drill steel coupling 10, threading onto drill steel shaft 11 having a drill bit 47 at an opposite distal end. A slidable engine cradle allows for up and down travel of the engine 5 and gear reduction transmission drive box 7 for vertical drilling.

Mounted on the side of steel swivel 9 is securely mounted injection inlet tube 12 which allows passage for the air or water or mud injection or combination thereof from air/water injection flow control valve system regulator unit A8, which is passed down through the center of the hollow drill steel 11 to the distal end exiting the drill bit 47. This provides the means for adjustable rotary air/water injection drilling methods and/or mud injection drilling methods combining all or portions of, adjusting methods for various rock formations.

The air/water injection flow control valve system regular unit A8 is controlled by a water flow control—water side check valve 13 which is connected to a water hose or water source. At the distal end of air/water injection flow control valve system regulator unit A8 is an air flow control valve 14 connected for high pressure air.

On the left side of the engine cradle 6 is a left mount bushing 16 inside the left pull-down cable spring mount 15. Also on the right side of the engine cradle 6 is a right mount bushing 18 provided for the right pull-down cable spring mount 17. Following is the right pull-down spring 20 opposite of which there is a left pull-down spring 19. Attached to the left pull-down spring 19 is a left cable turn buckle 21. Mirrored on the right is the right cable turn buckle 22 to adjust tension on the left pull-down cable 23 opposite the right pull-down cable 24.

Extending downwardly toward the main base and toward the outside of the left mast pole 2 and the right mast pole 3 is the left base cable pulley 25 and the right base cable pulley 26. Attached at that point on the rear of the main base are a left cable slack adjuster spring 27 and opposite a right cable slack adjuster spring 28. On the left rear of the main base 1 the cable then follows through a left rear cable guide pulley 29 and on the opposite side of the main base 1 the right rear cable guide pulley 30. The pull-down cables 23 and 24 together are guided upwardly on the back side of the rear mast pole 4, on through a lower cable guide eye bolt 31 passing on upward through the upper cable guide eye bolt 32 where together the cables 23 and 24, are spooled onto the cable pull-down system winch A5, positioned midway on the rear mast pole 4. A spool 33 is divided by a spool driver plate 34, which separates the pull-down cable spool side 35 and hoist cable spool side 36, which is turned by winch crank handle 37 for hoisting capabilities by means of hoist cable 38 attached over the tee top 48 on top cable pulleys 49 back downward to attach on engine cradle 6 or reverse direction for pull-down capabilities.

As winch handle 37 is cranked in the reverse position winding cables 23 and 24 onto pull-down cable spool side 35 and pulling tension on the pull-down springs 19 and 20, downward pressure is applied on the engine cradle 6 providing mechanical pull-down pressure capabilities. Cable pull-down system winch A5 is a two-speed winch with locking capabilities to maintain pull-down pressure tension on springs 19 and 20 in a constant pressure mode.

To further enhance the pull-down capabilities there is a weight bar pull-down assist A6 mounted on the top of the engine cradle 6 with a left side of bar 42 and a right side of bar 43, which holds left side weights 44 and also right side weights 45. These weights are secured in place by a weight lock 46 on each distal end of the weight bar A6. These weights are providing a downward force on the engine 5 ultimately relaying to the pressure on the drill bit 47, preventing the engine from jumping. In operation, the pull-down assist weights A6 are adjustable until the engine 5 drills smoothly and effectively as different types of rock formation are drilled through to achieve smooth operation.

Engine 5 controls are located on rear mast pole 4 above the location of the cable pull-down system winch A5. Throttle 39 and engine stop switch 40 together, are located on the left side of the rear mast pole 4. A throttle cable 41 and stop wire shuttle up to the left side of the engine 5.

The present invention allows for performance of a drilling operation to be performed by one individual to access confined areas inaccessible to larger conventional drilling rigs and may also further be disassembled if required, and reassembled by one individual. Additionally, the simplicity of the present invention allows an individual with only limited training and experience to master the operations and repair the drilling unit in a short period of time.

Figure 2:
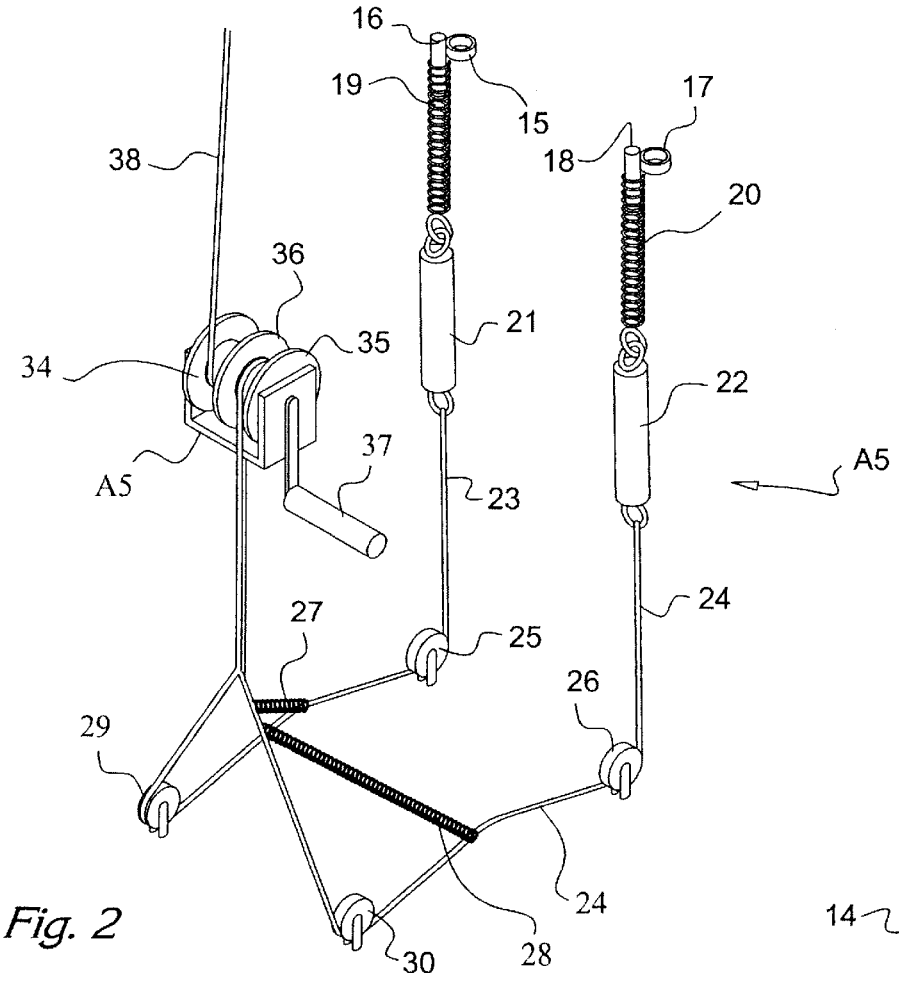
FIG. 2 is a front view of the mechanical pull down pressure system of the present invention.
Figure 3:
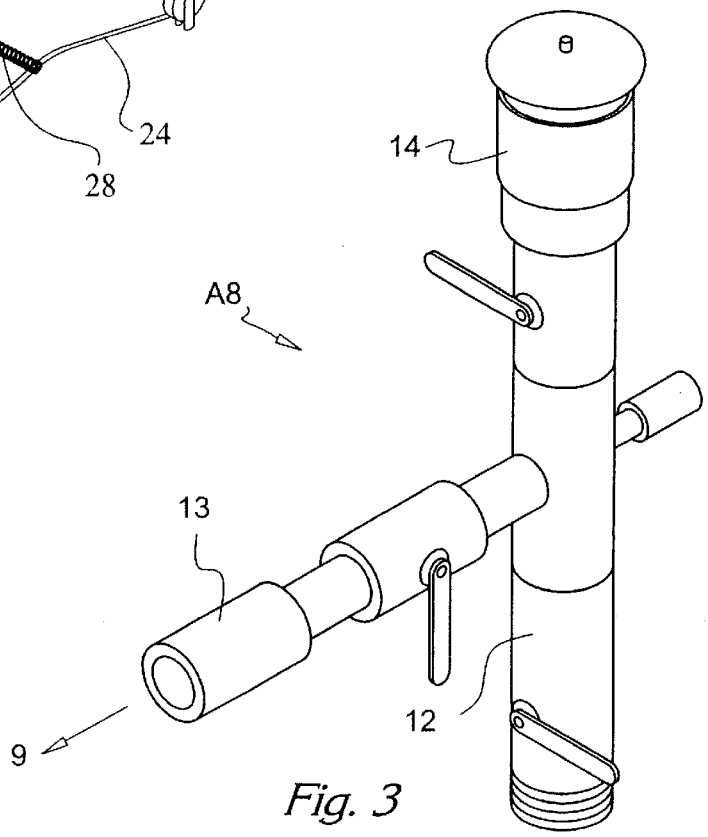
FIG. 3 is a side view of the injection flow control valve system of the present invention.

The compact portability of the present invention with operational features of a full size conventional drill rig allows for drilling maneuvers to be performed in typically impossible confined locations. Operation of the present invention will be discussed with respect to FIGS. 1 and 2.

In the preferred embodiment, the described water well drill 10 is fabricated such that all major, separable components have been designed to maintain a "bolt-on" status, full disassembly of the unit for transport is not necessary. The major sections consist of main base stabilizer rails platform, drill mast, engine, transmission, cable pull-down system, and air/water/mud injection flow control valve system regulator unit.

To use the portable drill of the present invention, when the desired drilling location is determined and reached, and starting with the engine in the lowered position, all fluid levels must first be checked. Weights are installed on each side of weight bar. The air supply hose is connected to air flow control valve. The water supply is connected to water flow control valve. The engine is hoisted to the top mast position. The user then installs the drill steel with the drill bit threaded and installed down through the drill steel opening at the main base water deflector shield and threads drill steel coupling to drill steel and to steel swivel located below the gear reduction transmission drive box. The drilling assembly is now ready for drilling to begin. The user switches the engine stop switch to the on position, and starts the engine.

Open throttle and open injection flow control valves accordingly. Grasp winch handle crank. Engage cable pull-down system winch to the neutral position and lower drill bit to the ground. Drill bit then cuts or loosens the earth.

The drilling fluid or air injection then lifts the bore hole/well cuttings up to the ground surface through an annulus formed between the outside of the drill pipe and walls of the well.

As the water table is penetrated the air will lift or circulate cuttings, displacing the same amount of water than the amount injected. This displacement of air lifting cuttings and fluid circulates and develops the well. As the engine assembly has lowered to the drill table, drilling is temporarily stopped and the drill pipe is disconnected from the steel swivel. The engine is hoisted to allow clearance for the next section of drill steel to be threaded to the steel swivel. The breaking out and connecting of drill pipe sections is performed on the drill steel table with a combination of pipe wrenches and locking wrenches to secure drill pipe. A wrench is used on the drill steel coupling and/or steel swivel to breakout or make-up drill pipe connections. Drilling operations can then continue after the next section of drill pipe is added or removed.

As porous subsurface formations are reached, the adjustment of air/water pressure or mud viscosity of drilling fluid is increased until stabilized or drill fluid circulation is acceptable and under control. As denser rock formations are encountered or drilled, air/water pressure can be adjusted or decreased to control the flow of circulation or flow of bore hole cuttings up to the ground surface. When the desired bore hole or water well depth is reached, the drilling mud is stabilized or air/water pressure increased and to insure the integrity of the bore hole or water well. This will enable the well to be fully developed and all cuttings removed through the circulation process. Once the final depth is achieved, removal of drill steel begins. After drill steel is removed bore hole or water well, well casing can then be installed if required. If the well or bore hole collapses, steel casing is installed in the pilot hole and driven to refusal. Rotary drilling then can restart and drilling continued inside the casing to remove the cave in material and drilled further down beyond the casing penetrating the rock until well integrity and water requirements are satisfied.

It is to be understood that the above-described arrangements are only illustrative of the application of the principles of the present invention. Numerous modifications and alternative arrangements will be apparent to those skilled in the art that various changes can be made in the details and construction of the apparatus disclosed herein without departing from the spirit and scope of the invention. Such changes and detail are included within the scope of this invention and the appended claims are intended to cover such modifications and arrangements.

It will be understood that each of the elements described above, or two or more together, may also find a useful application in other types of constructions differing from the type described above.

While the invention has been illustrated and described as embodied in a water well drill, it is not intended to be limited to the details shown, since it will be understood that various omissions, modifications, substitutions and changed in the forms and details of the device illustrated and in its operation can be made by those skilled in the art without departing in any way form the spirit of the present invention.

Without further analysis, the foregoing will so fully reveal the gist of the present invention that other can, by applying current knowledge, readily adapt it for various applications without omitting features that, from the standpoint of prior art, fairly constitute essential characteristics of the generic or specific aspects of this invention.

What is claimed as new and desired to be protected by letters patent is set forth in the appended claims:

What is claimed is:

1. A highly portable drilling apparatus useful in drilling well bores, which can be manually disassembled, transported, and reassembled in various locations and is specifically fabricated to allow an operator to maneuver the drilling apparatus in confined locations, said apparatus comprising:

a base;

a mast support system detachably affixed to said base, said mast support system comprising a left substantially vertical pole, a right substantially vertical pole, and a rear substantially vertical pole, said poles attached at top distal ends via a top pole-joining device;

a mechanical pull-down pressure system comprising a winch, a first and a second pull-down cable, a first and a second spring, a left turn buckle and a right turn buckle, and a left and a right spring mount;

a flow control valve system slidably connected to said mast support system;

a power unit with gear reduction transmission box, said power unit connected to said control valve system, wherein said power unit and gear reduction transmission box are slidably and removably mounted within said detachable mast support system by means of a cradle; and a weight bar pull-down assist mounted atop said cradle.

2. The portable drilling apparatus of claim 1 wherein said base further comprises at least one stabilizer rail extending therefrom.

3. The portable drilling apparatus of claim 1 wherein said base includes a front stabilizer rail, a center stabilizer rail and a rear stabilizer rail, said rear stabilizer rail includes a mobile unit wheel dolly system comprised of mounted wheels on distal ends of said rear stabilizer rail.

4. The portable drilling apparatus of claim 3 wherein said mobile unit wheel dolly system comprises a left side wheel and a right side wheel thereby providing manual mobility without unit disassembly.

5. The portable drilling apparatus of claim 1, said base further comprising a primary deflector shield and a secondary deflector shield.

6. The portable drilling apparatus of claim 5 wherein said primary deflector shield is comprised of a flat rubber material that protects the operator from injury and the power unit from premature failure caused by well bore debris.

7. The portable drilling apparatus of claim 6 wherein said primary deflector shield further includes a sealing orifice opening for passage of a drill steel.

8. The portable drilling apparatus of claim 5 wherein said secondary deflector shield further includes a guide opening for passage of a drill steel.

9. The portable drilling apparatus of claim 1 wherein said winch is comprised of a common spool with a divider plate in a center of said spool thereby separating said winch into a left side and a right side, wherein said left side of said winch has pull-down capabilities and said right side of said winch has hoisting capabilities.

10. The portable drilling apparatus of claim 1 wherein said weight bar pull-down assist is mounted on said cradle, said weight bar pull-down assist allows for weights to be added to each side of said cradle thereby providing an adjustable means of downward pressure to facilitate drilling.

11. The portable drilling apparatus of claim 1 wherein said flow control valve system comprises an air injection port, a water injection port and a mud injection port wherein said fluid injection ports are flow-controlled by separate flow control valves.

12. The portable drilling apparatus of claim 1 further comprising a guide having a guide opening, said guide securely fastened between said left vertical pole and said right vertical pole.

13. The portable drilling apparatus of claim 1 wherein said power unit is an engine.

14. A highly portable drilling apparatus useful in drilling well bores, which can be manually disassembled, transported, and reassembled in various locations and is specifically fabricated to allow an operator to maneuver the drilling apparatus in confined locations, said apparatus comprising:

a base including a front stabilizer rail, a center stabilizer rail and a rear stabilizer rail, said rear stabilizer rail includes a mobile unit wheel dolly system comprised of mounted wheels on distal ends of said rear stabilizer rail;

a mast support system detachably affixed to said base, said mast support system comprising a left substantially vertical pole, a right substantially vertical pole, and a rear substantially vertical pole, said poles attached at top distal ends via a top pole-joining device;

a mechanical pull-down pressure system comprising a winch, a first and a second pull-down cable, a first and a second spring, a left turn buckle and a right turn buckle, and a left and a right spring mount;

said winch is comprised of a common spool with a divider plate in a center of said spool thereby separating said winch into a left side and a right side, wherein said left side of said winch has pull-down capabilities and said right side of said winch has hoisting capabilities;

a flow control valve system slidably connected to said mast support system wherein said flow control valve system comprises an air injection port, a water injection port and a mud injection port wherein said injection ports are flow-controlled by separate flow control valves;

an engine with gear reduction transmission box, said engine connected to said injection control valve system, wherein said engine and said gear reduction transmission box are slidably and removably mounted within said detachable mast support system by means of a cradle;

a weight bar pull-down assist mounted atop said cradle;

a primary deflector shield and a secondary deflector shield, wherein said primary deflector shield is comprised of a flat rubber material that protects the operator from injury and the engine from premature failure caused by well bore debris; and said primary deflector shield further includes a sealing orifice opening for passage of a drill steel and said secondary deflector shield further includes a guide opening for passage of said drill steel.

* * * * *